US005351492A

United States Patent [19]

Agrawal et al.

[11] Patent Number: 5,351,492

[45] Date of Patent: Oct. 4, 1994

[54] DISTILLATION STRATEGIES FOR THE PRODUCTION OF CARBON MONOXIDE-FREE NITROGEN

[75] Inventors: Rakesh Agrawal, Emmaus, Pa.; Ajay K. Modi, Maryland Heights, Mo.; William T. Kleinberg, Breinigssville, Pa.

[73] Assignee: Air Products and Chemicals, Inc., Allentown, Pa.

[21] Appl. No.: 950,116

[22] Filed: Sep. 23, 1992

[51] Int. Cl.[5] ..... F25J 3/02

[52] U.S. Cl. ..... 62/24; 62/39

[58] Field of Search ..... 62/28, 24, 39, 44

[56] References Cited

U.S. PATENT DOCUMENTS

| | | | |
|---|---|---|---|
| 4,867,773 | 9/1989 | Thorngood et al. | 62/39 |
| 4,869,883 | 9/1989 | Thorngood et al. | 423/219 |
| 4,927,441 | 5/1990 | Agrawal | 62/28 |
| 4,994,098 | 2/1991 | Agrawal et al. | 62/22 |
| 5,006,137 | 4/1991 | Agrawal et al. | 62/11 |
| 5,077,978 | 1/1992 | Agrawal et al. | 62/24 |

*Primary Examiner*—Ronald C. Capossela
*Attorney, Agent, or Firm*—Willard Jones, II; William F. Marsh; James C. Simmons

[57] ABSTRACT

The present invention relates an improvement to a cryogenic process for the separation of air which produces at least a nitrogen product and is carried out in a distillation column system having at least one distillation column from which the nitrogen product is produced. The distillation column of the distillation column system must comprise a rectifying section. In the process of the present invention, air is compressed, freed of impurities which will freeze out at cryogenic temperatures, cooled to near its dew point and fractionated in the distillation column system to produce the nitrogen product.

The improvement is the operation of the distillation column such that the ratio of downward liquid to upward vapor flow rate (L/V) is no less than 0.65, preferably greater than 0.75, but less than 1.0 in the rectifying section of a distillation column from which the nitrogen product is produced. The flowrates are in moles per unit time.

15 Claims, 9 Drawing Sheets

DISTILLATION STRATEGIES FOR THE PRODUCTION OF CARBON MONOXIDE-FREE NITROGEN

TECHNICAL FIELD

The present invention relates to cryogenic distillation processes for the separation of air which produce a nitrogen product. More specifically, the present invention relates to the production of carbon monoxide-free nitrogen.

BACKGROUND OF THE INVENTION

Nitrogen is used extensively throughout a number of high-technology industries, including those concerned with the manufacture of ceramics, carbon fibers and silicon wafers. Nitrogen is a major chemical for the electronics industry and is by far the largest used gas in the production of semiconductor devices. Because the fabrication of silicon wafers requires extremely low-contaminant atmospheres, it is imperative that nitrogen for the electronics industry be supplied at high purity specifications.

The major source of nitrogen is air, from which it is typically produced by cryogenic separation. One of the contaminants in air is carbon monoxide; the carbon monoxide concentration in air is typically 0.1 to 2 vppm, but may be as high as 5 vppm. Due to the reactive nature of carbon monoxide, it extremely critical that the nitrogen delivered to the electronics industry be free of this impurity. The concentration of carbon monoxide in carbon monoxide-free nitrogen should be less than 0.1 vppm and preferably below 10 vppb. Thus, efficient processes for the production of carbon monoxide-free nitrogen are essential for the cost-effective manufacture of semiconductor devices.

The most common method for the production of nitrogen is by the cryogenic distillation of air. The distillation system typically consists of either a single distillation column or a double-column arrangement. Details of the single-column process can, be found in the "Background of the Invention" section of U.S. Pat. Nos. 4,867,773 and 4,927,441 assigned to Air Products. Details of the double-column nitrogen generator can be found in U.S. Pat. Nos. 4,994,098 and 5,006,137, also assigned to Air Products. However, in these known processes, a significant fraction of the carbon monoxide in the feed air shows up in the final nitrogen product. To overcome this inability of conventional air separation units in reducing the concentration of carbon monoxide in the nitrogen product, a number of schemes have been proposed. These previous solutions ,can all be classified into two major categories.

Processes in the first group remove the carbon monoxide up-front from the feed air, which is then sent to the distillation system for the production of the desired carbon monoxide-free nitrogen. In these processes, the carbon monoxide is usually removed using a noble metal catalyst such as the ones based on palladium or platinum. Compressed warm air is sent over a catalyst bed to react the carbon monoxide These catalysts are usually expensive.

Processes in the second class remove the carbon monoxide by further purifying the nitrogen that is produced by the distillation system. Usually some form of chemisorption operation is carried out to reduce the concentration of the carbon monoxide to the desired level. U.S. Pat. No. 4,869,883, assigned to Air Products, describes in detail a typical process that employs a catalytic purifier for the removal of carbon monoxide.

Both of the above-described solutions for the reduction of the carbon monoxide, concentration in the nitrogen product possess a number of inherent drawbacks. First, both schemes require the application of an additional unit operation on either the feed air or the standard nitrogen product from the distillation system to produce the desired product. This extra processing step adds complexity and cost to the overall process. In the case of the catalytic purifier, the additional operation can be very expensive since the catalyst used is often a noble metal such as platinum or palladium. Second, when the nitrogen gas is treated in a catalytic unit, particulates are introduced into the gas which subsequently need to be filtered out. Requiring a filtration system adds yet another processing step to the schemes, adding even further to the cost and complexity of the overall system.

Clearly then, it can be seen that there exists a need for a process for the production of carbon monoxide-free nitrogen that does not suffer from the weaknesses of the above-mentioned schemes. A desirable process would be one in which the concentration of the carbon monoxide in the nitrogen product is reduced directly within the distillation system, thus removing the need for additional processing steps.

SUMMARY OF THE INVENTION

The present invention relates an improvement to a cryogenic process for the separation of air which produces at least a nitrogen product and is carried out in a distillation column system having at least one distillation column from which the nitrogen product is produced. The distillation column of the distillation column system must comprise a rectifying section. In the process of the present invention, air is compressed, freed of impurities which will freeze out at cryogenic temperatures, cooled to near its dew point and fractionated in the distillation column system to produce the nitrogen product.

The improvement is the operation of the distillation column such that the ratio of downward liquid to upward vapor flow rate (L/V) is no less than 0.65, preferably greater than 0.75, but less than 1.0 in the rectifying section of a distillation column from which the nitrogen product is produced. The flowrates are in moles per unit time.

The present invention is particularly suited for use in a distillation column system that comprises a single rectification column or a distillation column system that comprises a higher pressure rectification column and a low pressure distillation column with a rectifying and stripping section, where both columns are in thermal communication with each other.

The carbon monoxide-free nitrogen product of the present invention can be further processed in a stripping column to strip out lighter boiling contaminant components such as neon, helium and hydrogen.

DETAILED DESCRIPTION OF THE INVENTION

The present invention is an improvement to a cryogenic air separation process which results in the production of carbon monoxide-free nitrogen. The improvement is the operation of the distillation column such that the ratio of downward liquid to upward vapor flow rate (L/N) is no less than 0.65, preferably greater than 0.75, but less than 1.0 in the rectifying section of a distillation column from which the nitrogen product is produced. The flowrates of both streams are defined in moles per unit time. This column can be either the sole column within a conventional single-column air separation system or either or both of the columns within a traditional double-column system. The required L/V ratio can be accomplished by the following means:

1. by co-producing less-pure nitrogen as a vapor product from an intermediate location within the distillation column;
2. by employing a heat pump in which column is vaporized;
3. by employing a heat pump in which the overhead vapor is compressed;
4. by employing a heat pump in which the bottoms liquid stream is subcooled;
5. by employing a heat pump in which the oxygen-rich waste stream from the top boiler/condenser is compressed; and
6. by employing a heat pump in which an external fluid is used as the heat-pump fluid.

Before describing the details of any of the above-mentioned schemes for the removal of carbon monoxide, a single-column air separation unit for the production of nitrogen will be described. Such an arrangement is depicted in FIG. 1.

Figure 1:
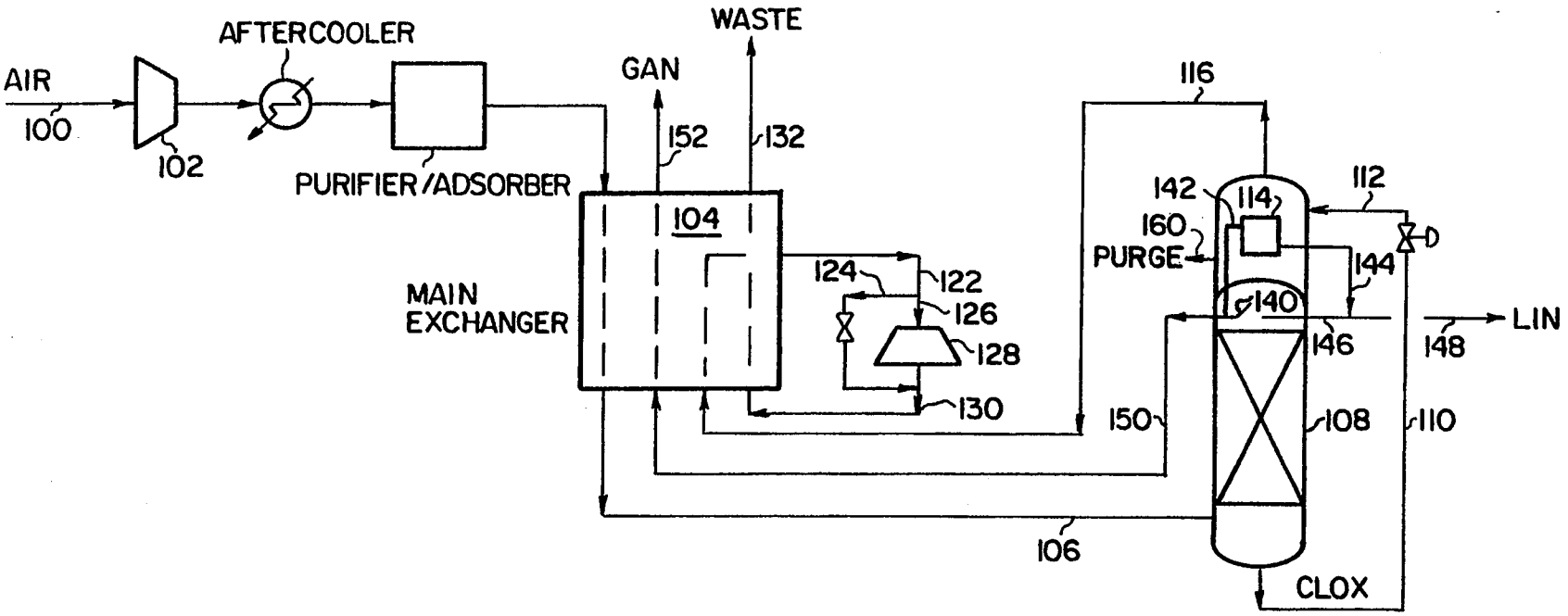
FIG. 1 PRIOR ART
FIG. 1 is a schematic of a conventional single column distillation process producing nitrogen.

With reference to FIG. 1, a feed air stream, in line 100, is compressed to about 5–15 psia above the nitrogen product delivery pressure in compressor 102. The compressed air is then aftercooled, purified of water, carbon dioxide and most hydrocarbon contaminants, cooled to near its dew point in main heat exchanger 104, and fed, via line 106, to single distillation column 108 for rectification into a pure nitrogen overhead and crude liquid oxygen bottoms.

The crude liquid oxygen bottoms is removed, via line 110, reduced in pressure and fed, via line 112, to the sump surrounding boiler/condenser 114. In boiler/condenser 114, at least a portion of the reduced pressure, crude liquid oxygen is boiled in heat exchange against condensing nitrogen overhead. In order to prevent the build up of hydrocarbons in the sump surrounding boiler/condenser 114, a small purge stream can be removed, via line 160. The vaporized crude oxygen is removed, via line 116, to provide the expander feed stream, in line 122. The bulk of the expander feed stream, in line 126, is work expanded in turbo expander 128. In order to balance the refrigeration needs of the process, a small side-stream, in line 124, can bypass turbo expander 128 and be reduced in pressure across a Joule-Thompson (J-T) valve. The expanded bulk stream and the reduced pressure side-stream are combined, warmed to recover refrigeration and vented to the atmosphere, via line 132.

The pure nitrogen overhead, in line 140, is split into two portions. A first portion, in line 142, is fed to and condensed in boiler/condenser 114 against vaporizing crude liquid oxygen bottoms. At least a portion of this condensed nitrogen overhead, in line 144, is fed, via line 146, to distillation column 108 as pure reflux. If needed, another portion can be recovered as liquid nitrogen product, via line 148. A second portion is removed, via line 150, warmed in heat exchanger 104 to recover refrigeration and recovered as pure nitrogen product, via line 152.

Table 1 presents the temperatures, pressures, flow rates and compositions of the column air feed, nitrogen product and crude liquid oxygen streams. These results were obtained by performing a computer simulation of the cycle.

TABLE 1

| Stream Number | Temp: °F. [°C.] | Pressure: psia [kPa] | Flow rate: mol/hr | Composition Nitrogen: mol % | Argon: mol % | Oxygen: mol % | CO: vppb |
|---|---|---|---|---|---|---|---|
| 106 | −269.8 [−167.7] | 121.7 [839] | 100 | 78.12 | 0.93 | 20.95 | 1,000 |
| 150 | −278.2 [−172.3] | 118.9 [820] | 42.4 | 99.82 | 0.18 | 0.00 | 1,038 |
| 110 | −269.8 [−167.7] | 121.7 [839] | 57.6 | 62.14 | 1.48 | 36.37 | 972 |

As can be seen, the FIG. 1 depicted distillation-column arrangement, i.e., the conventional single column system employed for the production of nitrogen, is clearly inadequate for the removal of carbon monoxide. The concentration of carbon monoxide in the nitrogen product remains at about 1 vppm, roughly, the same as its concentration in the air feed to the column. The L/V near the top of the distillation column is 0.60. These results clearly indicate the need to modify the distillation scheme in order to reduce the concentration of the carbon monoxide in the nitrogen to the desired level of less than 10 vppb.

All of the six earlier-mentioned embodiments of the present invention for the removal of carbon monoxide will now be described in greater detail within the context of a single-column air separation unit.

Figure 2:
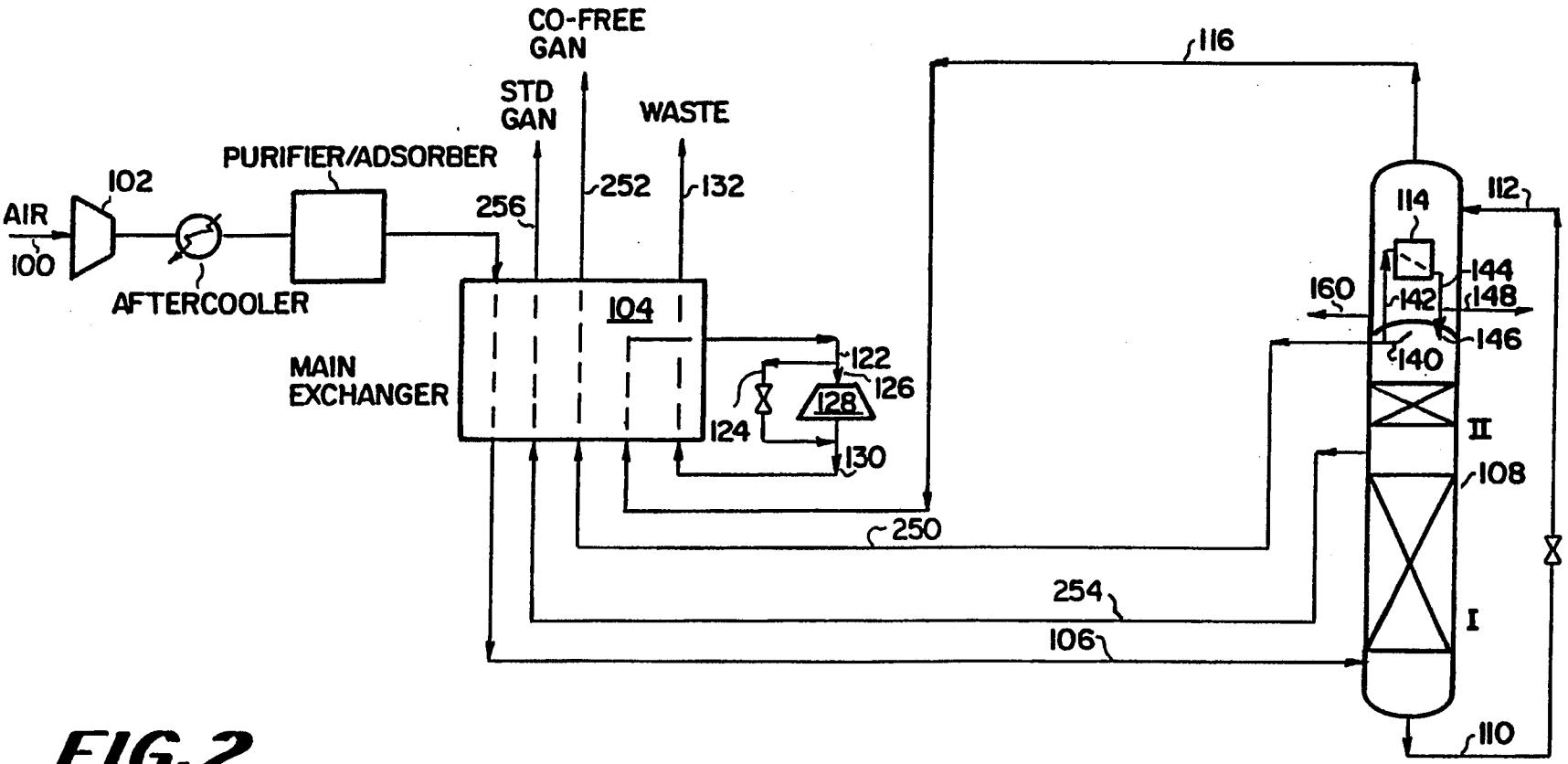
FIGS. 2–9 are schematic diagrams illustrating several embodiments of the process of the present invention.

FIG. 2 illustrates the first scheme. By drawing a standard nitrogen vapor product of normal oxygen impurity 1 to 1000 vppm, via line 254, from the top of section I of distillation column 108, the flow of vapor entering section II of the column is decreased. On the other hand, since the liquid flow through section II of distillation column 108 remains unchanged, the L/V ratio in that section increases. Therefore, by drawing a sufficiently large flow of nitrogen vapor, via line 254, the LA/ratio in section II of distillation column 108 can be increased to allow the liquid falling through this section to strip the carbon monoxide to its desired level from the vapor rising through the section. The nitrogen vapor drawn, via line 250, from the top of section II contains preferably less than 10 vppb carbon monoxide. The carbon monoxide-free nitrogen vapor, in line 250, is warmed in heat exchanger 104 to recover refrigeration and recovered as carbon monoxide-free nitrogen product at the desired pressure, via line 252. Generally, even though not essential, the total number of separation stages used in sections i and II of the distillation column in the FIG. 2 embodiment will be more than the number used in the conventional process of FIG. 1. The additional separation stages in section II allow higher recoveries of carbon monoxide-free nitrogen. The simulation results for the process of FIG. 2 are presented in Table 2.

TABLE 2

| Stream Number | Temp: °F. [°C.] | Pressure: psia [kPa] | Flow rate: mol/hr | Composition Nitrogen: mol % | Argon: mol % | Oxygen: mol % | CO: vppb |
|---|---|---|---|---|---|---|---|
| 106 | −269.8 [−167.7] | 121.9 [840] | 100 | 78.12 | 0.93 | 20.95 | 1,000 |
| 254 | −278.2 [−172.3] | 118.9 [820] | 29.9 | 99.67 | 0.33 | 0.00 | 1,500 |
| 250 | −278.8 [−172.7] | 116.5 [803] | 12.5 | 100.00 | 0.00 | 0.00 | 5 |

As can be seen from these results, the ability of this distillation scheme to produce a nitrogen product in which the concentration of carbon monoxide has been reduced to the desired level is demonstrated. The standard-grade nitrogen stream, in line 254, contains 1500 vppb of carbon monoxide, as compared to a carbon monoxide concentration of 5 vppb in the carbon monoxide-free stream, in line 250. An important advantage of the new scheme is that it can co-produce the carbon monoxide-free nitrogen at no significant additional energy cost over the conventional single-column waste-expansion cycle for the production of standard-grade nitrogen. Furthermore, the overall recovery of nitrogen (42.4 moles per 100 moles of column air) does not change relative to the conventional single-column cycle. The LA/ratio near the top of the section I is 0.59, which is similar to the one for the process in FIG. 1, while the L/V ratio in section II is 0.83.

Figure 3:
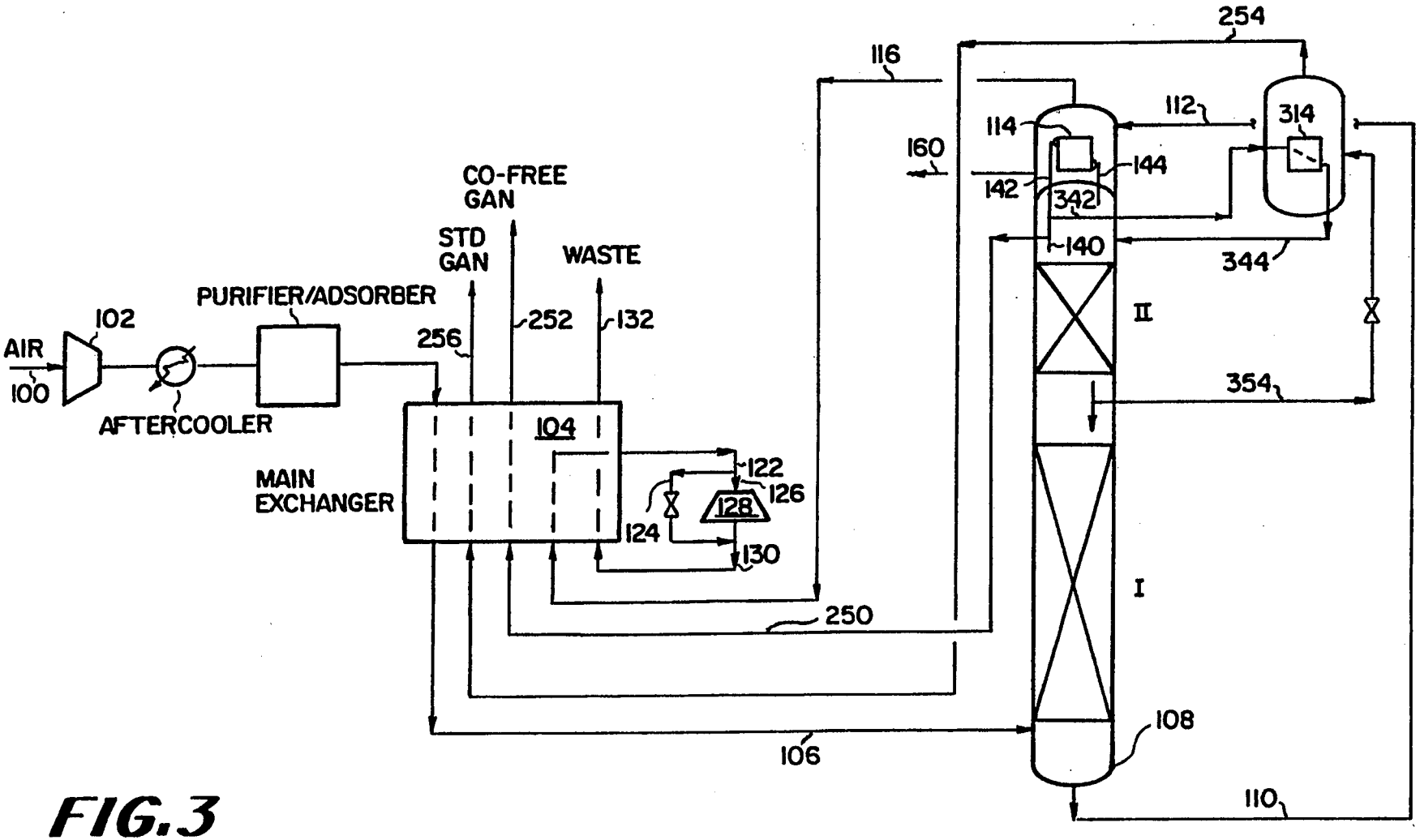

FIG. 3 illustrates how the appropriate L/V ratio is created in section II of distillation column 108 through the use of an internal nitrogen heat pump. In this scheme a liquid product containing normal oxygen impurity is drawn from the top of section II of the distillation column, via line 354. This stream is reduced in pressure by expanding it through a J-T valve. The expanded stream is then vaporized in boiler condense 314 by condensing a nitrogen vapor stream drawn, via line 342, from the top of section It of distillation column 108. The produced liquid nitrogen stream is returned, via line 344, to a suitable location in distillation column 108, typically to the stage from which the nitrogen vapor stream, in line 342, is drawn. By adjusting the flow of nitrogen liquid stream in line 354, the L/N value in section I can be set to an appropriate value. The nitrogen overhead stream, in line 250, which contains less than 10 vppb carbon monoxide, is warmed in heat exchanger 104 to recover refrigeration and delivered, via line 252, as carbon monoxide-free nitrogen product at the desired pressure. The use of this internal heat pump increases the liquid flow and vapor flow in section II while maintaining the desired value of LA/, thus, allowing an increased production of carbon monoxide-free nitrogen.

The simulation results for the process of FIG. 3 are presented in Table 3.

TABLE 3

| Stream Number | Temp: °F. [°C.] | Pressure: psia [kPa] | Flow rate: mol/hr | Composition Nitrogen: mol % | Argon: mol % | Oxygen: mol % | CO: vppb |
|---|---|---|---|---|---|---|---|
| 106 | −269.8 [−167.7] | 121.9 [840] | 100 | 78.12 | 0.93 | 20.95 | 1,000 |
| 354 | −278.2 [−172.3] | 118.9 [820] | 25.4 | 99.73 | 0.27 | 0.00 | 1,600 |
| 254 | −281.2 [−174.0] | 105.5 [727] | 25.4 | 99.73 | 0.27 | 0.00 | 1,600 |
| 250 | −278.8 [−172.7] | 116.5 [803] | 17.0 | 100.00 | 0.00 | 0.00 | 3 |

As can be seen, by using an internal heat pump in which the liquid drawn from an intermediate point in the column, allows a greater fraction of the total nitrogen product to be recovered carbon monoxide-free than the cycle without the heat pump allows. By this cycle, 17 moles of carbon monoxide-free nitrogen are recovered for every 100 moles of column air. The overall recovery of nitrogen (42.4 moles) remains the same. The concentration of carbon monoxide in the nitrogen product (stream 955) is 3.2 vppb. The L/V in section II is 0.84.

Figure 4:
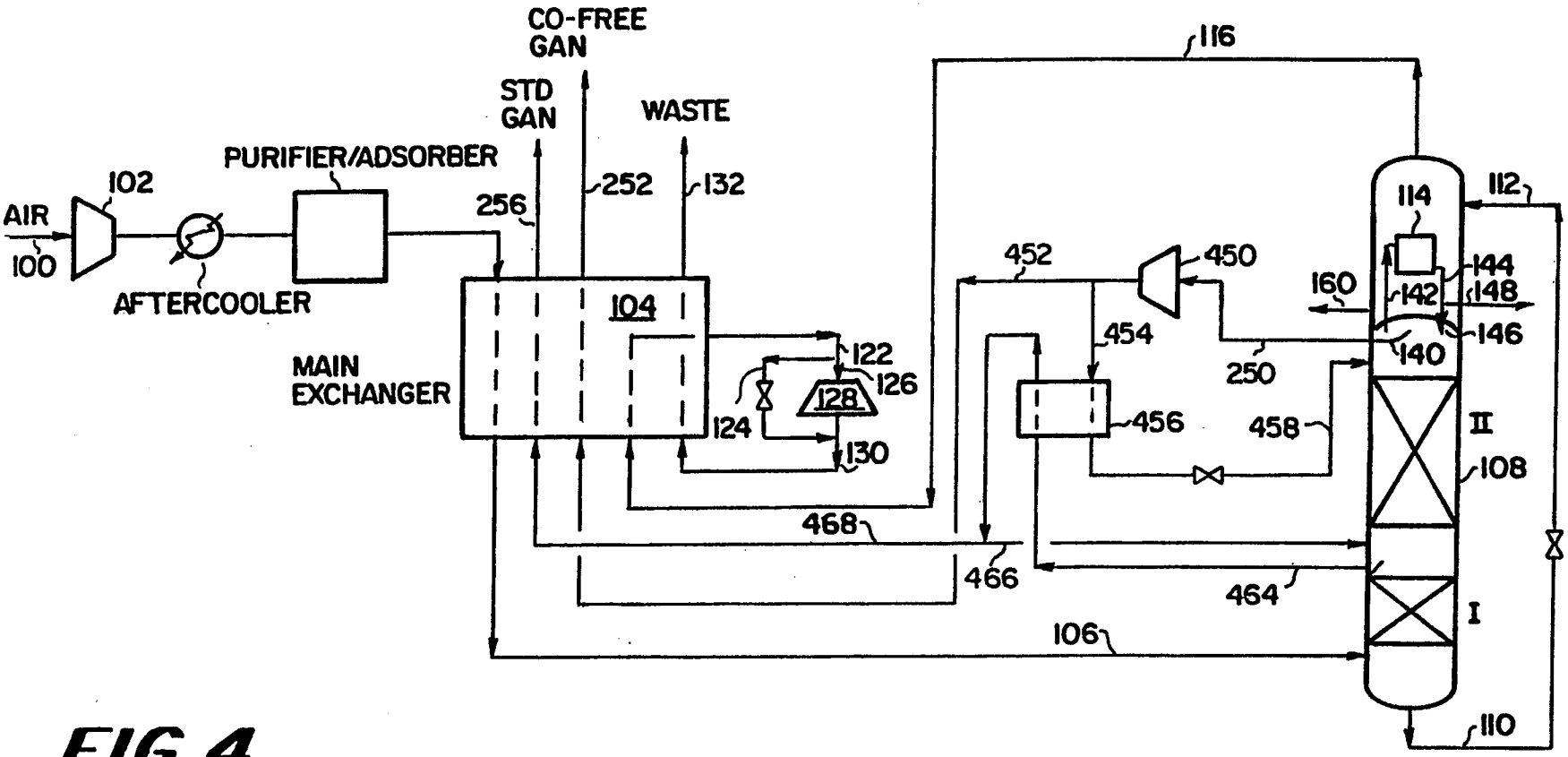

FIG. 4 illustrates how an open-loop heat pump can be employed to generate the appropriate L/V ratio in section II of the distillation column. With reference to FIG. 4, a liquid stream, in line 464, is drawn from the top of section I of column 108 and vaporized in heat exchanger 456. This gaseous nitrogen is then divided into two streams. One portion of the nitrogen, in 468, is warmed in heat exchanger 104 and delivered, via line 256, as standard-grade nitrogen product. The second fraction of gaseous nitrogen, in line 466, is returned to distillation column 108 to the stage from which the liquid, in stream 464 is drawn. The flow of nitrogen, in stream 466 can be varied depending upon the fraction of nitrogen that is required as standard-grade product. The gaseous nitrogen from stream 466 mixes with the vapor in the column and rises through section II, From the top of section II in column 108, a vapor stream, in line 250 is drawn and compressed in compressor 450. The stream emerging from the compressor is spit into two substreams, in line 452 and 454. The latter substream, in line 454, is condensed to vaporize nitrogen liquid, in line 464, in exchanger 456. The condensed stream is expanded across a J-T valve and returned, via line 458, to a suitable location in distillation column 108, typically, the stage from which the nitrogen, in line 250, is withdrawn from. The former substream, in line 452, which contains less than 10 vppb carbon monoxide, is warmed in heat exchanger 104 and delivered, via line 252, as the desired carbon monoxide-free nitrogen product.

In FIG. 4, the vapor stream, in line 250, is cold compressed. Alternatively, this stream could be warmed in main heat exchanger 104, boosted in pressure, cooled in main heat exchanger 104 and, then, condensed in heat exchanger 456. In another alternative, all of the vapor drawn from the top of distillation column 108 need not be compressed; the carbon monoxide-free nitrogen product could be split from it. The remaining stream is boosted in pressure and used analogous to stream 454. In yet another alternative, the standard grade nitrogen need not be withdrawn as a fraction of the vaporized stream, in line 468, but could be withdrawn as a separate stream from a suitable location of distillation column 108.

As an alternative to the embodiment shown in FIG. 4, the pressure of stream 250 does not need to be increased, i.e., the pressure of condensing stream 454 can be the same as stream 250. However, if the pressure of streams 454 and 250 are the same, the pressure of liquid stream 464 must be decreased so it can be boiled in heat exchanger 456, and the pressure of stream 466 will need to be boosted so that it can be fed to distillation column 108.

Figure 5:
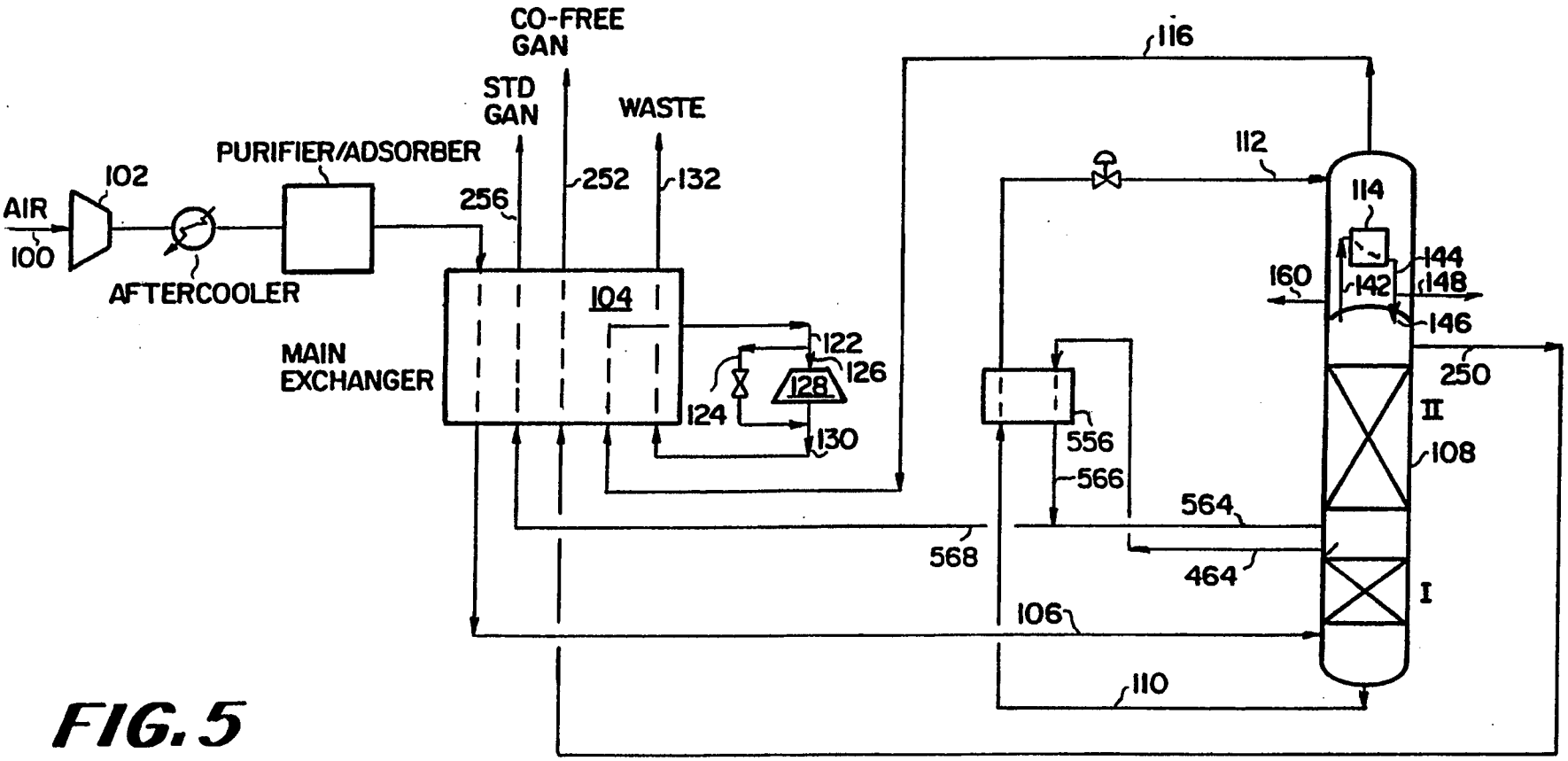

FIG. 5 illustrates how the crude liquid oxygen stream, in line 110, is used as the heat-pump fluid. A liquid stream, in line 464, is withdrawn from the top of section 1 of distillation column 108 and vaporized by heat exchange in heat exchanger 556 with the crude liquid oxygen bottoms stream, in line 110. The vaporized stream, in line 566, is mixed with a vapor stream, in line 564, withdrawn from the same stage of distillation column 108, to form the nitrogen stream, in line 568, which, in turn, is warmed in main heat exchanger 1 04 and delivered, via line 256, as a standard-grade nitrogen product. The subcooled crude liquid oxygen stream exiting exchanger 556 is reduced in pressure across a valve and fed, via line 112, to the sump surrounding boiler/condenser 114.

The vapor stream withdrawn, via line 250, from the top of section II of distillation column contains less than 10 vppb carbon monoxide. This stream is warmed in main heat exchanger 104 and delivered, via line 252, as the desired carbon monoxide-free nitrogen product.

Figure 6:
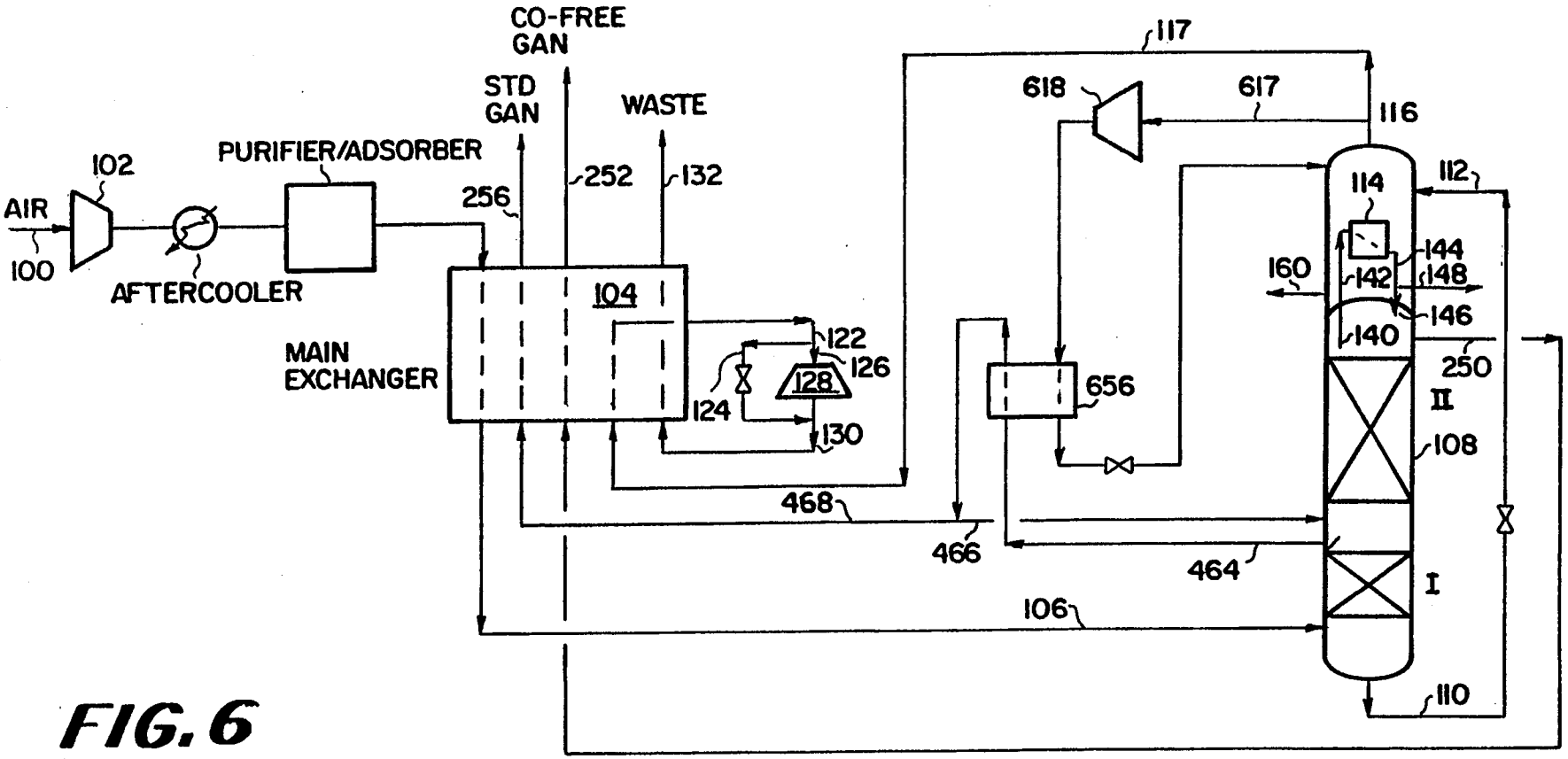

FIG. 6 depicts how a closed-loop heat pump is used to create the desired nitrogen product. A portion, in line 61 7, of the waste vapor stream, in line 116, from the boiler/condenser at the top of distillation column 108 is compressed in compressor 618, condensed in heat exchanger 656 against vaporizing nitrogen liquid, in line 464, reduced in pressure across a J-T valve and returned to the boiling side of the boiler/codenser 114. The nitrogen liquid stream, in line 464, contains from 0.1 to 10 vppm oxygen and is withdrawn from the top of section I of column 108, vaporized in heat exchanger 656, and split into two substreams. The first substream, in line 466, is returned to a suitable location of distillation column 108, preferably near the stage from which the nitrogen liquid stream, in line 464, was withdrawn. The second substream, in line 468, is warmed in heat exchanger 104 and recovered, via line 256, as standard nitrogen product. The high purity nitrogen stream, which contains less than 10 vppb carbon monoxide is withdrawn, via line 250, as a vapor from the top of section II of column 108, warmed in heat exchanger 104, and delivered, via line 252, as the desired nitrogen product.

Alternatively, standard grade nitrogen may not be withdrawn as a fraction of the vaporized stream, in line 468, but could be withdrawn as a separate stream from a suitable location of distillation column 108. In such a case, the concentration of oxygen in stream 464 is not limited to be less than 10 vppm and could be at any suitable value.

Figure 7:
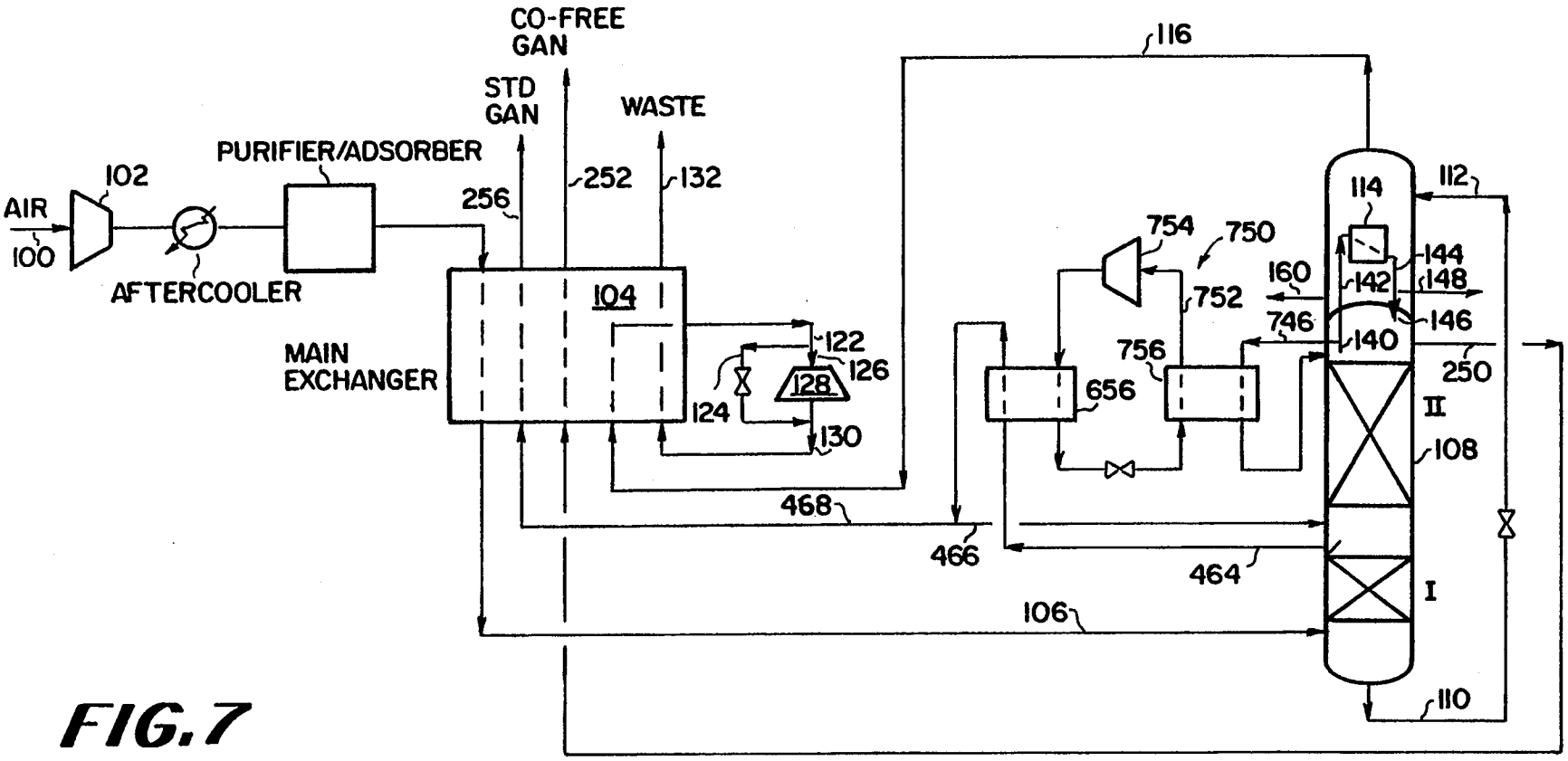

FIG. 7 illustrates how an external refrigerant is used as the heat-pump fluid A nitrogen liquid stream is drawn from a suitable location at the top of section 1 of distillation column 108, vaporized in heat exchanger 656 against the refrigerant stream. The vaporized nitrogen stream is divided into two pads. The first part, in line 468, is warmed in heat exchanger 104 and delivered, via line 256, as standard-grade nitrogen The second portion is returned, via line 466, to a suitable location of distillation column 108, typically, at the stage from which the nitrogen liquid was withdrawn. A warm, refrigerant stream, in line 752, is compressed in compressor 754, cooled in heat exchanger 656, reduced in pressure across a J-T valve and warmed in heat exchanger 756. A nitrogen vapor stream, in line 746, is withdrawn from the top of section II of distillation column 108, condensed in heat exchanger 756 and returned to the top of distillation column 108 as additional reflux. A vapor stream, in line 250, is withdrawn from the top of section II of distillation column 108 contains less than 10 vppb carbon monoxide. This vapor stream is warmed in heat exchanger 104 and delivered, via line 252, as the desired carbon monoxide-free nitrogen product.

All of the six previously described schemes for the removal of carbon monoxide can also be employed within any nitrogen generating double-column air separation unit to produce carbon monoxide-free nitrogen. As an example, FIG. 8 illustrates how the second scheme (employing a heat pump in which the column liquid is vaporized) can be used to produce carbon monoxide-free nitrogen from the high pressure column of a conventional double column process.

Figure 8:
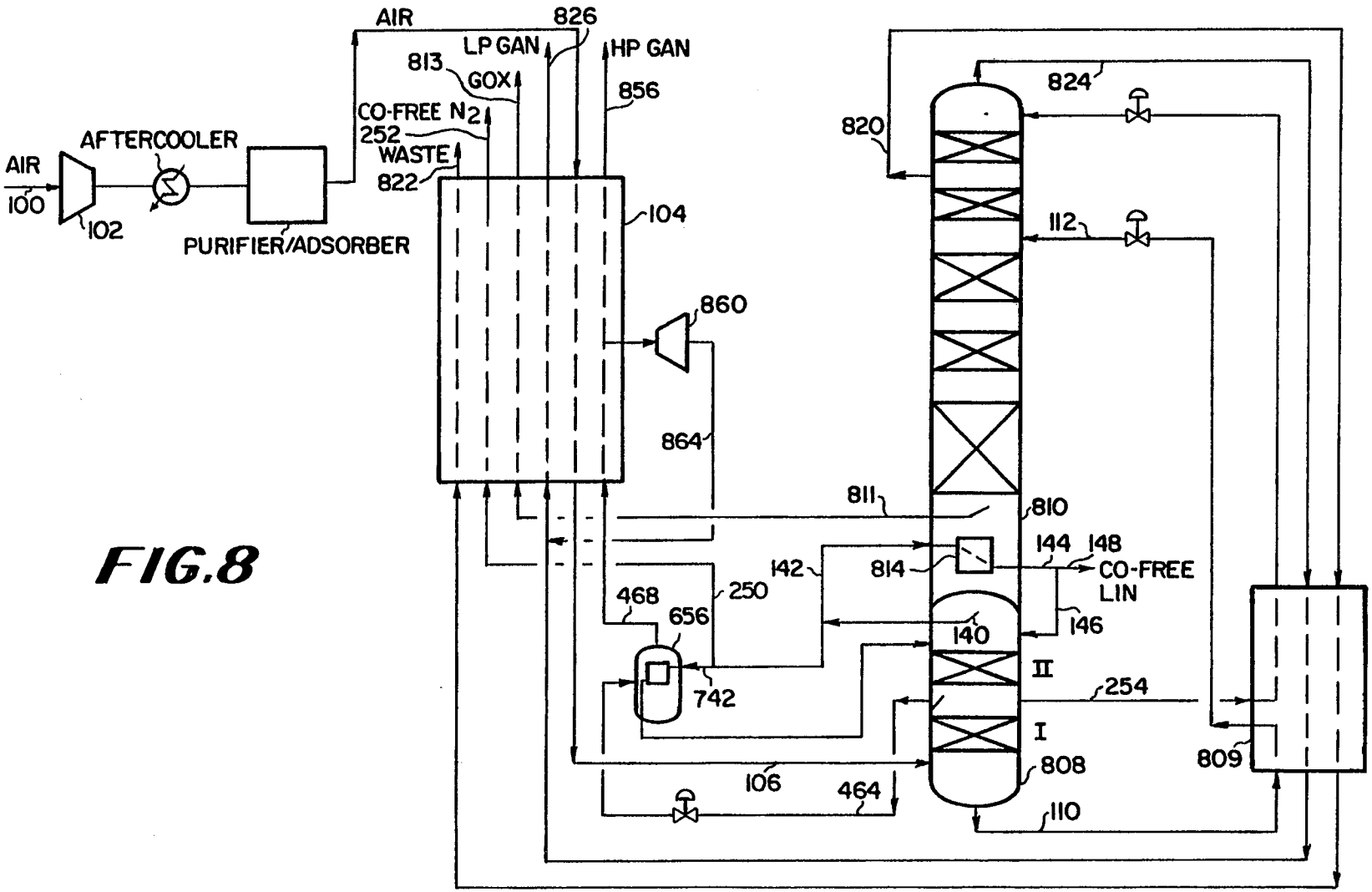

With reference to FIG. 8, feed air, in line 100, is compressed in compressor 102, purified of contaminants, cooled to near its dew point in main heat exchanger 104 and fed, via line 106 to high pressure distillation column 808. In column 805, the air is rectified into a crude liquid oxygen bottoms and pure high pressure nitrogen overhead. The high pressure nitrogen overhead is removed, via line 140, and split into three portions. The first portion, in line 142, is condensed by heat exchange against vaporizing purity liquid oxygen bottoms in boiler/condenser 814 located in the bosom of low pressure column 81 0 and returned to high pressure column 808 as reflux. A portion of the condensed carbon monoxide-free stream, in line 144, can be easily withdrawn as carbon-monoxide-free liquid nitrogen product, via line 148. The second portion, in line 250, is warmed in main heat exchanger 104. The warmed stream is then recovered, via line 252, as carbon monoxide-free nitrogen. The third portion, in line 742, is condensed in boiler/condenser 656 against vaporizing reduced pressure, nitrogen liquid, in line 464, which has been removed from the top of section I of high pressure column 808; the condensed nitrogen portion is returned to high pressure column 808 as additional reflux. The vaporized nitrogen stream, in line 468, from boiler/condenser 656 is warmed in main heat exchanger 104 and recovered, via line 856, as the high pressure nitrogen stream. Midway through heat exchanger 104, a side-stream of high pressure nitrogen is removed and work expanded to generate refrigeration. The crude liquid oxygen bottoms is removed, via line 110, from high pressure column 808, subcooled in heat exchanger 809, reduced in pressure and fed, via line 112, into an intermediate location of low pressure column 810.

In low pressure column 810, the crude liquid oxygen is distilled into a purity liquid oxygen bottoms and a low pressure nitrogen overhead. It is worth noting that the nitrogen reflux to low pressure column 81 0 is not provided from the top of high pressure column 808 but from the top of section I as stream 254. This source of reflux increases the L/V in section II of high pressure column 808 and allows the production of carbon monoxide-free nitrogen. A gaseous oxygen stream is removed, via line 811 from the bottom of low pressure column 810, warmed in heat exchanger 104 to recover refrigeration and recovered as oxygen product, via line 81 3. A nitrogen waste stream is removed, via line 820, from a upper location of low pressure column 810, warmed in heat exchangers 809 and 104 and vented to the atmosphere, via line 822. A low pressure purity nitrogen stream is removed, via line 824, from low pressure column 810, warmed in heat exchangers 809 and 1 04, combined with the expanded nitrogen side-stream, in line 864, and recovered as low pressure nitrogen product, via line 826.

Alternatively, if a smaller quantity of carbon monoxide-free nitrogen is required, the nitrogen-rich vapor stream to be expanded may be directly withdrawn from the HP column. This will change L/V in the top section II and carbon monoxide-free nitrogen is co-produced, in stream 250 and/or in stream 148. In this case, boiler/-condenser 656 is not used. In yet another alternative, a portion of the feed air may be expanded for refrigeration and, except for the reflux to the low pressure column, in line 252, no nitrogen-rich stream is withdrawn from high pressure column 808. A small quantity of the carbon-free nitrogen stream is withdrawn from the top of section II of high pressure column 808 in line 148 and/or stream 250.

Figure 9:
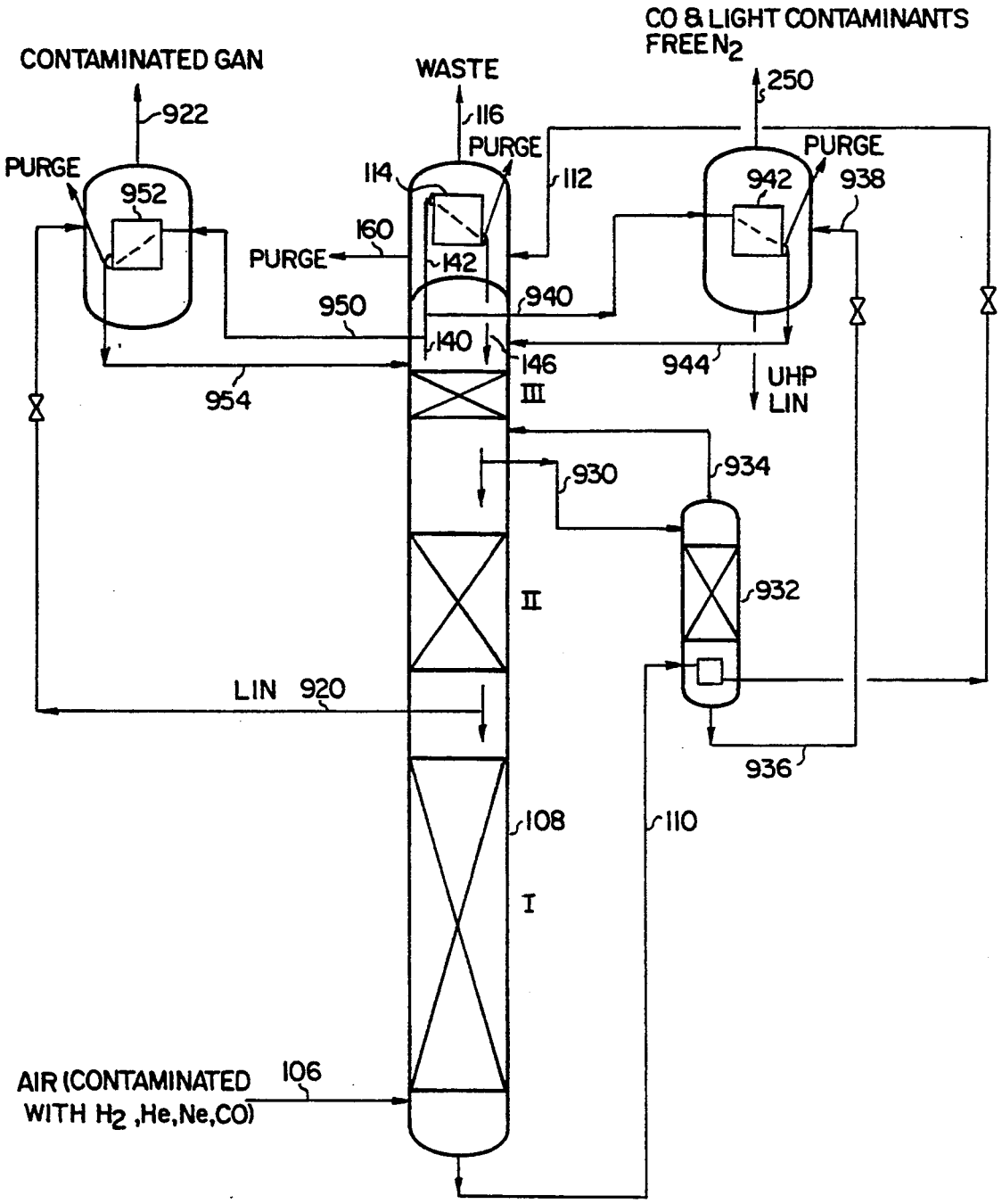

Numerous schemes are known for the production of nitrogen in which the concentrations of the light impurities (neon, hydrogen and helium) are each less than 10 vppb. Such schemes can be found in U.S. Pat. Nos. 5,137,559 and 5,123,947 and U.S. patent application Ser. No. 07/750,332. Any of the above schemes for carbon monoxide removal can be combined with any of the known lights-free nitrogen schemes to produce nitrogen in which the concentrations of the light components and carbon monoxide are each less than 10 vppb. FIG. 9 depicts one example of such a combined scheme.

With reference to FIG. 9, cooled, compressed, contaminants-free feed air is fed, via line 106, to single distillation column 108 for rectification. In column 108, this feed air is separated into a crude liquid oxygen bottoms and a nitrogen overhead. The crude liquid oxygen bottoms is removed, via line 110, subcooled in the boiler/condenser located in the bottom of stripper column 932, reduced in pressure and fed, via line 112, to the sump surrounding boiler/condenser 114. In boiler condenser 114, this subcooled, reduced pressure, crude liquid oxygen bottoms is vaporized in heat exchange with condensing portion of the nitrogen overhead.

The nitrogen overhead, in line 140, is split into three portions. A first portion, in line 142, is fed to and condensed in boiler/condenser 114 by heat exchange against boiling crude liquid oxygen. The condensed first portion is returned, via line 146, to the top of column 108 as reflux. A second portion, in line 940, is fed to and condensed in boiler/condenser 942 in heat exchange against a boiling nitrogen process stream. The condensed second portion is returned, via line 944, to the top of column 108 as reflux. A third portion, in line 950, is fed to and condensed in boiler/condenser 952 in heat exchange against a boiling nitrogen process stream. The condensed third portion is returned, via line 954, to the top of column 108 as reflux.

A first descending column liquid nitrogen stream, in line 930, is withdrawn from column 108 a few stages below the top and fed to stripping column 932. In column 932, the removed, first descending column liquid nitrogen stream (which is essentially a carbon-monoxide-free nitrogen contaminated with light impurities), is stripped of light component contaminants producing a stripper column vapor overhead and a stripper column liquid bottoms. This produced vapor overhead is returned, via line 934, to an appropriate location in column 108, preferably to the same location of column 108 as where the liquid was removed. Boilup for column 932 is provided by boiling a portion of the stripper column liquid bottoms by heat exchange against subcooling crude liquid, in line 110. Another portion of the stripper column liquid bottoms is removed, via line 936, reduced in pressure and vaporized in boiler/condenser 942 against condensing nitrogen overhead. The vaporized liquid is recovered as carbon monoxide-free and light contaminants-free nitrogen product.

Finally, a second descending column liquid nitrogen stream, in line 920, is removed from column 108 at an appropriate location below the withdraw point of the first descending column liquid stream. This second liquid stream is reduced in pressure and vaporized in boiler/condenser 952 by heat exchange against condensing nitrogen overhead. The produced vapor is recovered as a contaminated nitrogen product.

Table 4 contains some simulation results that verify the performance of the cycle in co-producing nitrogen that is both carbon monoxide-free and lights-free.

TABLE 4

| Stream Number | Temp: °F. [°C.] | Press: psia [kPa] | Flow rate: mol/hr | Composition $N_2$: mol % | Ar: mol % | $O_2$: mol % | Ne: vppb | CO: vppb |
|---|---|---|---|---|---|---|---|---|
| 106 | −269.8 [−168] | 121.9 [840] | 100 | 78.12 | 0.93 | 20.95 | 18,200 | 1,000 |
| 920 | −278.2 [−172.3] | 118.9 [820] | 31.9 | 99.71 | 0.29 | 0.00 | 518 | 1,400 |
| 922 | −281.2 [−174.0] | 106.1 [732] | 31.9 | 99.71 | 0.29 | 0.00 | 518 | 1,400 |
| 936 | −278.6 [−172.6] | 117.5 [810] | 10.5 | 100.00 | 0.00 | 0.00 | 5 | 3 |
| 250 | −281.2 | 106.5 | 10.5 | 100.00 | 0.00 | 0.00 | 5 | 3 |

TABLE 4-continued

| Stream Number | Temp: °F. [°C.] | Press: psia [kPa] | Flow rate: mol/hr | Composition $N_2$: mol % | Ar: mol % | $O_2$: mol % | Ne: vppb | CO: vppb |
|---|---|---|---|---|---|---|---|---|
| | [−174.0] | [734] | | | | | | |

As can be seen, the concentration of carbon monoxide and neon in feed air to the column (line 106), are respectively 1,000 and 18,200 vppb. In the ultra-high purity nitrogen product (line 250), these concentrations have respectively been reduced to 3.1 and 4.9 vppb. Since neon is the heaviest (least volatile) of the three light impurities of interest, the concentrations of the remaining two lights, i.e., hydrogen and helium, will be even less than that of neon. In the standard-grade nitrogen product (line 922), the concentration of carbon monoxide is 1400 vppb and the concentration of neon is 518 vppb. Again, as with the other schemes described previously, the total recovery of nitrogen is the same as the recovery obtained when only standard-grade nitrogen is produced from the process. In all the above discussions, the concentration of carbon monoxide in the carbon monoxide-free nitrogen was taken to be less than 10 vppb. This is the preferred range. The method suggested here can be used to decrease carbon monoxide concentration below 0.1 vppm in a nitrogen product stream. In summary, all of the six schemes of this invention described above can be used to co-produce carbon monoxide-free nitrogen directly from the cold box. These schemes have the inherent advantage of not requiring additional unit operations, a major drawback of currently used processes, to remove the carbon monoxide from the nitrogen. Furthermore, the total nitrogen recovery obtained from these new schemes are the same as the recovery obtained from conventional processes.

All of the six schemes can be used in conjunction with either the single-column nitrogen generator or the double-column arrangement. The carbon monoxide-removal schemes can also be combined with all the known schemes for lights-free nitrogen to produce ultra-high purity nitrogen.

The present invention has been described with reference to several specific embodiments thereof. These embodiments should not be viewed as a limitation of the present invention. The scope of the present invention should be ascertained from the following claims.

We claim:

1. A cryogenic process for the separation of air which produces at least a nitrogen product and is carried out in a distillation column system having at least one distillation column from which the nitrogen product is produced, wherein said distillation column, has at least the rectifying section, wherein, the feed thereto comprises nitrogen, oxygen, argon and carbon monoxide which is rectified to separate out nitrogen from the feed, characterized by operating the rectifying section of the distillation column from which the nitrogen product is produced at a ratio of downward liquid flow rate to upward vapor flow rate L/V) is greater than 0.65 and less than 1.0, thereby maximizing the separation between nitrogen and carbon monoxide and thus, producing a carbon monoxide-free nitrogen product.

2. The process of claim 1 wherein the ratio of downward liquid flow rate to upward vapor flow rate (L/V) is greater than 0.75 and less than 1.0.

3. The process of claim 1 wherein the distillation column system comprises a single rectification column and wherein the carbon monoxide-free nitrogen product is produced at or near the top of the single rectification column.

4. The process of claim 3 which further comprises stripping the carbon monoxide-free nitrogen product in a stripping column to strip out lighter boiling contaminant components.

5. The process of claim 4 wherein said lighter boiling contaminant components comprise neon, helium and hydrogen.

6. The process of claim 1 wherein the distillation column system comprises a higher pressure rectification column and a low pressure distillation column with a rectifying and stripping section, wherein both columns are in thermal communication with each other.

7. The process of claim 6 wherein the carbon monoxide-free nitrogen product is produced at or near the top of the high pressure rectification column.

8. The process of claim 1 wherein the operation of said rectifying section is accomplished by removing a sufficient quantity of nitrogen having a nitrogen purity less than that of the carbon monoxide-free nitrogen product from an intermediate location of rectifying section so that the ratio of downward liquid flow rate to upward vapor flow rate (L/V) in the rectifying section is greater than 0.65 and less than 1.0.

9. The process of claim 8 wherein the nitrogen removed from the intermediate location is gaseous nitrogen and is recovered as gaseous nitrogen co-product.

10. The process of claim 8 wherein the rectifying section is the high pressure column of a double column distillation system and the nitrogen removed from the intermediate location is a liquid stream which is used to provide reflux to the low pressure column.

11. The process of claim 1 wherein the operation of said rectifying section is accomplished by employing a heat pump which comprises removing liquid nitrogen having a nitrogen purity less than that of the carbon monoxide-free nitrogen product from an intermediate location of rectifying section; reducing the pressure of the removed liquid nitrogen; vaporizing the reduced pressure, liquid nitrogen in heat exchange against condensing nitrogen overhead; recovering the vaporized nitrogen as a co-product and returning the condensed nitrogen overhead to the rectifying section as reflux, whereby the removed liquid nitrogen and the returned condensed nitrogen overhead are in sufficient quantities so that the ratio of downward liquid flow rate to upward vapor flow rate (L/V) in the rectifying section is greater than 0.65 and less than 1.0.

12. The process of claim 1 wherein the operation of said rectifying section is accomplished by employing a heat pump which comprises removing and compressing a portion of the nitrogen overhead of the rectifying section; removing liquid nitrogen having a nitrogen purity less than that of the carbon monoxide-free nitrogen product from an intermediate location of rectifying section, condensing the removed; compressed nitrogen overhead portion and vaporizing the removed liquid nitrogen by heat exchange against each other; returning at least a portion of the vaporized nitrogen to the intermediate location of the rectifying section and returning the condensed nitrogen to the rectifying section as reflux, whereby the removed liquid nitrogen, the returned nitrogen vapor and the returned condensed nitrogen overhead are in sufficient quantities so that the ratio of downward liquid flow rate to upward vapor flow rate (L/V) in the rectifying section is greater than 0.65 and less than 1.0.

13. The process of claim 1 wherein the operation of said rectifying section is accomplished by employing a heat pump which comprises removing liquid nitrogen having a nitrogen purity less than that of the carbon monoxide-free nitrogen product from an intermediate location of rectifying section; removing gaseous nitrogen having a nitrogen purity less than that of the carbon monoxide-free nitrogen product from an intermediate location of rectifying section; subcooling crude liquid oxygen; vaporizing The removed liquid nitrogen; condensing nitrogen overhead by heat exchange against vaporizing, subcooled crude liquid oxygen; recovering the vaporized nitrogen and the removed gaseous nitrogen as a co-product and returning the condensed nitrogen to the rectifying section as reflux, whereby the removed liquid nitrogen, the removed gaseous nitrogen and the returned condensed nitrogen overhead are in sufficient quantities so that the ratio of downward liquid flow rate to upward vapor flow rate (L/V) in the rectifying section is greater than 0.65 and less than 1.0.

14. The process of claim 1 wherein the operation of said rectifying section is accomplished by employing a heat pump which comprises condensing nitrogen overhead against vaporizing crude liquid oxygen; returning the condensed nitrogen to the rectifying section as reflux; compressing a portion of the vaporized crude oxygen; removing liquid nitrogen having a nitrogen purity less than that of the carbon monoxide-free nitrogen product from an intermediate location of the rectifying section; condensing the compressed, vaporized crude oxygen and vaporizing the removed liquid nitrogen by heat exchange against each other; reducing in pressure and then vaporizing the condensed crude oxygen for heat exchange with the condensing nitrogen overhead; returning at least a portion of the vaporized nitrogen to the intermediate location of the rectifying section and returning the condensed nitrogen to the rectifying section as reflux, whereby the removed liquid nitrogen, the returned portion of the vaporized nitrogen and the returned condensed nitrogen overhead are in sufficient quantities so that the ratio of downward liquid flow rate to upward vapor flow rate (L/V) in the rectifying section is greater than 0.65 and less than 1.0.

15. The process of claim 1 wherein the operation of said rectifying section is accomplished by condensing nitrogen overhead by heat exchange against closed loop heat pump fluid; returning the condensed nitrogen to rectifying section as reflux; removing liquid nitrogen having a nitrogen purity less than that of the carbon monoxide-free nitrogen product from an intermediate location of rectifying section; vaporizing the removed liquid nitrogen by heat exchange against the closed-loop heat pump fluid; returning at least a portion of the vaporized nitrogen to the intermediate location of the rectifying section and returning the condensed nitrogen to the rectifying section as reflux, whereby the removed liquid nitrogen, the returned portion of the vaporized nitrogen and the returned condensed nitrogen overhead are in sufficient quantities so that the ratio of downward liquid flow rate to upward vapor flow rate (L/V) in the rectifying section is greater than 0.65 and less than 1.0.

* * * * *